US008291693B2

(12) United States Patent
Odendall

(10) Patent No.: US 8,291,693 B2
(45) Date of Patent: Oct. 23, 2012

(54) METHOD FOR SETTING A PREDETERMINED OXYGEN FILLING VALUE OF AN OXYGEN STORAGE RESERVOIR OF A CATALYTIC CONVERTER

(75) Inventor: Bodo Odendall, Lenting (DE)

(73) Assignee: Audi AG, Ingolstadt (DE)

( * ) Notice: Subject to any disclaimer, the term of this patent is extended or adjusted under 35 U.S.C. 154(b) by 597 days.

(21) Appl. No.: 12/332,434

(22) Filed: Dec. 11, 2008

(65) Prior Publication Data

US 2009/0151324 A1 Jun. 18, 2009

(30) Foreign Application Priority Data

Dec. 14, 2007 (DE) ..... 10 2007 060 331

(51) Int. Cl.
*F01N 3/00* (2006.01)

(52) U.S. Cl. ..... 60/285; 60/274; 60/276

(58) Field of Classification Search ..... 60/274, 60/276, 277, 285; 701/103, 109
See application file for complete search history.

(56) References Cited

U.S. PATENT DOCUMENTS

| | | | | |
|---|---|---|---|---|
| 5,839,274 | A * | 11/1998 | Remboski et al. | 60/274 |
| 5,842,340 | A * | 12/1998 | Bush et al. | 60/274 |
| 5,941,918 | A * | 8/1999 | Blosser | 701/29 |
| 6,116,021 | A * | 9/2000 | Schumacher et al. | 60/274 |
| 6,446,429 | B2 * | 9/2002 | Kobayashi et al. | 60/285 |
| 6,453,662 | B1 * | 9/2002 | Lewis et al. | 60/277 |
| 6,964,159 | B2 * | 11/2005 | Lewis et al. | 60/285 |
| 2005/0223696 | A1 * | 10/2005 | Odendall | 60/274 |
| 2006/0032216 | A1 * | 2/2006 | Odendall | 60/285 |

FOREIGN PATENT DOCUMENTS

DE 10 2005 029 633 B3 12/2006

* cited by examiner

*Primary Examiner* — Thomas Denion
*Assistant Examiner* — Diem Tran
(74) *Attorney, Agent, or Firm* — Novak Druce + Quigg LLP

(57) ABSTRACT

A method for setting a predetermined oxygen filling value of an oxygen storage reservoir of a catalytic converter for a motor vehicle, the oxygen filling value being set with consideration of a combustion air ratio which has been determined depending on the raw emission values which have been determined or which are to be determined for the exhaust gas components which are to be oxidized and reduced by the catalytic converter.

8 Claims, 3 Drawing Sheets

METHOD FOR SETTING A PREDETERMINED OXYGEN FILLING VALUE OF AN OXYGEN STORAGE RESERVOIR OF A CATALYTIC CONVERTER

The invention relates to a method for setting a predetermined oxygen filling value of an oxygen storage reservoir of a catalytic converter for a motor vehicle as well as an associated device and an associated motor vehicle.

BACKGROUND OF THE INVENTION

In lambda control of a motor vehicle, that is, when setting a suitable combustion air ratio for a motor vehicle, which is done mass-based using the oxygen storage capacity (OSC), balancing of the current degree of oxygen filling of the catalytic converter is of special importance. For balancing of oxygen entry and oxygen discharge generally a formula is used which is based on the idea that the catalytic converter should be able to accept or release the entire oxygen excess or the entire oxygen deficiency in the exhaust gas if the oxygen storage reservoir of the catalytic converter is not completely filled or is completely empty.

But it is problematic in this type of control that catalytic converters which, for example, during an acceleration phase, are exposed to high masses of exhaust gas, show nitrogen oxide breakthroughs ($NO_x$ breakthroughs) even though the average charging of the oxygen storage reservoir has been reduced to values of less than 50%. The reason for this is that, as a result of the aforementioned balancing approach according to which once the theoretical filling state of the catalytic converter has been brought to the desired value of less than 50%, a lambda value of 1 is again set, that is, a stoichiometric ratio at which ratio nitrogen oxide breakthroughs which can be considered to be disadvantageous appear in an exhaust gas test.

The object of the invention is thus to devise a method which has been improved in this respect.

SUMMARY OF THE INVENTION

To achieve this object, a method for setting a predetermined oxygen filling value of an oxygen storage reservoir of a catalytic converter for a motor vehicle is provided which is characterized in that the oxygen filling value is set with consideration of a combustion air ratio which is determined depending on the raw emission values which have been determined or which are to be determined for the exhaust gas components which are to be oxidized and reduced by the catalytic converter.

In the method according to the invention therefore using the raw emission values for the exhaust gas components which are to be oxidized and reduced, a suitable combustion air ratio is set such that the desired theoretical oxygen filling value is assumed so that the problem of nitrogen oxide breakthroughs is avoided which has existed in the past due to the fact that the lambda control immediately returns to a lambda value of 1 after reaching the theoretical charging state of the catalytic converter. Rather the storage and discharge behavior of the oxygen in the catalytic converter is imaged with greater precision, its being considered, in particular, that the catalytic converter is exposed both to exhaust gas components which are to be oxidized and also exhaust gas components which are to be reduced in the region of a combustion air ratio of lambda=1.

The corresponding raw emission values for the exhaust gas components which are to be oxidized and reduced are incorporated into the examination within the framework of setting the oxygen filling value, and the specific oxygen discharge characteristic and the specific oxygen storage characteristic for the catalytic converter can be used. The desired OSC charging state is then set with consideration of the observation that for the oxygen storage curve optionally a value assigned to the desired theoretical oxygen charging other than for the oxygen discharge curve arises. Thus a combustion air ratio can be determined which optionally deviates more or less from the value lambda=1, but which is suitable for maintaining the desired degree of oxygen filling and thus for avoiding breakthroughs of nitrogen oxides.

Advantageously, within the framework of the method according to the invention raw emission values for hydrocarbons and carbon monoxide are determined as the exhaust gas components which are to be oxidized and/or for nitrogen oxides and oxygen as the exhaust gas components which are to be reduced.

This is based on that fact that the exhaust gas components which are to be oxidized and to which the catalytic converter is also exposed in the region of the presence of a stoichiometric combustion air ratio, arise based on hydrocarbon (HC) and carbon monoxide (CO) raw emissions, the exhaust gas components to be reduced based on raw emissions with respect to nitrogen oxides ($NO_x$) and oxygen ($O_2$). Depending on in what oxygen charging state the catalytic converter is currently found, the oxidation or otherwise the reduction proceeds better or worse.

Accordingly, the oxygen filling state of the catalytic converter which is to be determined also changes.

For raw emission values which can occur, CO emission of 8000 ppm, $C_3H_8$ emission of 1000 ppm, $O_2$ emission of 7500 ppm and $NO_x$ emission of 1500 ppm can be cited by way of example, with which conversion of oxygen of 9000 ppm arises even in the region of a lambda value of 1.

The invention calls for the balancing of oxygen entry into the catalytic converter and/or of oxygen discharge from the catalytic converter to be able to be weighted by way of the relative oxygen filling of the catalytic converter such that the reaction rate of the oxygen entry rises with a decrease of the relative oxygen filling and/or the reaction rate of oxygen discharge drops as the relative oxygen filling decreases and/or the reaction rate of oxygen entry declines with an increase of relative oxygen filling and/or the reaction rate of oxygen discharge increases with the increase of the relative oxygen filling.

Accordingly, weighting, for example, with respect to oxygen entry can therefore be carried out such that it is considered that the reaction rate which is assigned to this oxygen entry rises when the degree of oxygen filling of the catalytic converter decreases and declines when the degree of oxygen filling increases. Accordingly, the reaction rate of oxygen discharge can or will drop when the relative oxygen filling decreases and will or can rise for an increase. On this basis, weighting can be adapted within the framework of balancing.

According to the invention, the combustion air ratio can be determined depending on the raw emission values converted to the change of the oxygen filling value of the oxygen storage reservoir of the catalytic converter as a function of the mass flow of exhaust gas.

In this connection, the converted values can be used, in particular, for correction of a formula for oxygen entry and oxygen discharge into and out of the oxygen storage reservoir of the catalytic converter.

To date it has been conventional, in the balancing of oxygen entry and oxygen discharge, to assume the following formula $$63.89*(\text{Lambda}-1)*\text{exhaust gas mass [kg/h]}$$

the factor of 63.89 being based on molar mass considerations for air.

With the correction according to the invention the conversion to oxygen entry in mg/s as a function of the mass flow of the exhaust gas for oxygen conversion of 9000 ppm yields the following formula:

$$\frac{9000}{3600}*\frac{32}{28,8}*\text{exhaust gas mass}\left[\frac{\text{kg}}{\text{h}}\right].$$

Here the value of 9000 in the numerator is formed by the oxygen conversion of 9000 ppm, the value of 3600 in the denominator by the conversion between hours and seconds, while the quotient of 32:28.8 goes back to the molar mass ratio of oxygen and nitrogen.

According to the invention, the combustion air ratio can be determined as a function of the values of an oxygen storage curve and an oxygen discharge curve of the oxygen storage reservoir of the catalytic converter, which values are assigned to a predetermined oxygen filling value.

For computing the oxygen balance this means that for a lambda value<1 the following formulas should be adopted:

$$\left(\left((63,89*(\text{Lambda}-1))-\left(\frac{9000}{3600}*\frac{32}{28,8}\right)\right)*\text{exhaust gas mass}\left[\frac{\text{kg}}{\text{h}}\right]\right)*\text{oxygen discharge characteristic}+\left(\left(\frac{9000}{3600}*\frac{32}{28,8}\right)*\text{exhaust gas mass}\left[\frac{\text{kg}}{\text{h}}\right]\right)*\text{oxygen storage characteristic}$$

For the case of a lambda value>1 accordingly the following arises:

$$\left(-\left(\frac{9000}{3600}*\frac{32}{28,8}\right)*\text{exhaust gas mass}\left[\frac{\text{kg}}{\text{h}}\right]\right)*\text{oxygen discharge characteristic}+\left(\left((63,89*(\text{Lambda}-1))+\left(\frac{9000}{3600}*\frac{32}{28,8}\right)\right)*\text{exhaust gas mass}\left[\frac{\text{kg}}{\text{h}}\right]\right)*\text{oxygen storage characteristic}$$

Based on these formulas which image the oxygen storage and discharge behavior with greater precision and with consideration of exposure both to the exhaust gas components to be oxidized and those to be reduced, the problem of breakthroughs of nitrogen oxides can be avoided by a suitable lambda value being set which is in the region of lambda=1, but which deviates at least slightly from a lambda value of 1.

Advantageously then, the oxygen filling value is set for a catalytic converter which is in the equilibrium state.

For example, in turn at an assumed oxygen conversion of 9000 ppm, a theoretical OSC filling state of 15% oxygen filling which is to be kept (in equilibrium) can be predetermined. At this filling state, for example, the oxygen storage curve has a value of 50% and the oxygen discharge curve has a value of 90%. If the catalytic converter is to be kept in equilibrium, this means that as much oxygen must be stored as is discharged. Accordingly the following arises:

$$\left(-\left(\frac{9000}{3600}*\frac{32}{28,8}\right)*\text{exhaust gas mass}\left[\frac{\text{kg}}{\text{h}}\right]\right)*0,5=\left(\left((63,89*(\text{Lambda}-1))+\left(\frac{9000}{3600}*\frac{32}{28,8}\right)\right)*\text{exhaust gas mass}\left[\frac{\text{kg}}{\text{h}}\right]\right)*0.9.$$

Solution of this equation in terms of lambda yields a lambda value of approximately 0.98. At this lambda value thus the catalytic converter is kept in an OSC charging state of 15% oxygen charging, the disruptive nitrogen oxide breakthroughs which have occurred previously being avoided. The input lambda must therefore assume a value of 0.98 in order to keep the catalytic converter with the storage and discharge curves assumed here at the low OSC filling state of 15%. By this modal consideration of the conversion behavior of the individual pollutants according to the invention a lambda value can thus be determined so that in fact the desired theoretical filling state can be kept stable without pollutant breakthroughs.

The method according to the invention is carried out preferably when there are large masses of exhaust gas. In this case deviations in the storage and discharge behavior are especially important, even at low degrees of filling.

Moreover, the invention relates to a device for setting a predetermined oxygen filling value of the oxygen storage reservoir of a catalytic converter for a motor vehicle which is made for setting the oxygen filling value with consideration of a combustion air ratio which is determined depending on the raw emission values which have been determined or which are to be determined for the exhaust gas components which are to be oxidized and reduced by the catalytic converter, in particular according to the method as described above.

Therefore, based on the above described method, the device determines a suitable combustion air ratio which can especially easily deviate from a lambda value of 1 in which it is possible to keep the catalytic converter at the desired theoretical filling state with oxygen, even if there is the situation of the presence of large masses of exhaust gas.

The method according to the invention is carried out preferably when there are large masses of exhaust gas. In this case the deviations in the storage and discharge behavior are especially important, in particular at low degrees of filling.

Advantageously, as mentioned, the method according to the invention is carried out by the device when there are large masses of exhaust gas. In this case, larger differences between the conversion curves assigned to the individual pollutants arise not least in the region of smaller degrees of oxygen filling, for example, around 30%. If here examination which is differentiated for the individual types of pollutants is not done, breakthroughs of nitrogen oxides encountered in the existing prior art are inevitable.

The device according to the invention acquires optionally from its own memory device or by access to an external memory the data which are required for determining the suitable lambda value in order to keep the catalytic converter at a fixed oxygen filling state in equilibrium. For this purpose the memory may contain, in particular, the oxygen discharge curve and the oxygen storage curve, differentiated by types of pollutants, that is, separately, for example, for hydrocarbons, carbon monoxide, and nitrogen oxides. Using these curves for a desired filling state with oxygen, the conversion value which is decisive for storage and discharge can be determined and used. With consideration of the raw emission values it is then possible to specify a lambda value such that the desired theoretical oxygen value for the catalytic converter can be maintained.

In order to carry out the computation which is necessary for this purpose, the device according to the invention has the corresponding computing means or has access to the algorithms which are required for this purpose.

Moreover, the invention relates to a motor vehicle with a device as described above, which has a device for setting a predetermined oxygen filling value as described above and which is made with the device. In this case the device is an onboard device of the motor vehicle.

But it is likewise conceivable for the device according to the invention to be made not as an onboard device, but to be external with respect to the motor vehicle on a test bench, in order, for example, to determine lambda values which are suitable specifically for the catalytic converter located in the motor vehicle, and which then can be filed in a memory device belonging to the vehicle for setting in later motor vehicle operation or used for comparison purposes, etc.

Other advantages, features and details of the invention will become apparent using the following embodiments and from the drawings.

DETAILED DESCRIPTION OF THE PREFERRED EMBODIMENTS OF THE INVENTION

Figure 1:
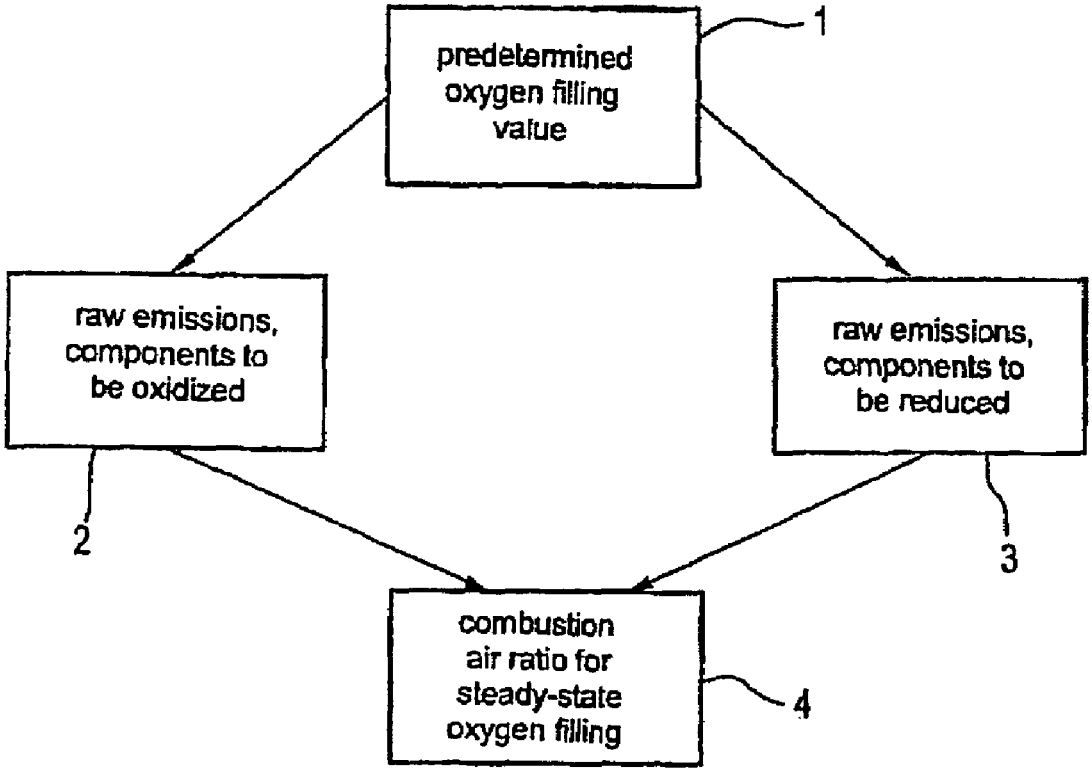
FIG. 1 shows a schematic for execution of the method according to the invention.

FIG. 1 shows a schematic for execution of the method according to the invention, the starting point according to box 1 being a predetermined degree or value of oxygen filling which is to be maintained. For example, a theoretical charging state of the catalytic converter of 15% oxygen can be predetermined.

On this basis, according to the invention as specified in boxes 2 and 3, consideration of the raw emissions of the components to be oxidized and the raw emissions of the components to be reduced is undertaken; it is considered that the catalytic converter in the region around lambda=1 is also exposed to the exhaust gas components which are to be oxidized and to be reduced. The data on oxygen conversion are transmitted to a device for executing the method or are determined by it for this purpose. Taking into account the raw emissions which have been differentiated by pollutants and preferably additionally of the oxygen storage and oxygen discharge curves, according to box 4, a combustion air ratio is determined which reliably leads to steady-state setting of the desired theoretical oxygen filling so that the previously occurring breakthroughs of individual types of pollutants are avoided. This combustion air ratio which leads to steady-state setting of the desired degree of oxygen filling will thus deviate somewhat from the stoichiometric lambda value of 1, that is, for example, at a theoretical oxygen filling value of 15%, raw emissions of 9000 ppm of the components which are to be oxidized and reduced, a value of the oxygen storage curve of 50%, and a value of oxygen discharge curve of 90% for the desired oxygen charging, it will be approximately lambda=0.98.

Figure 2:
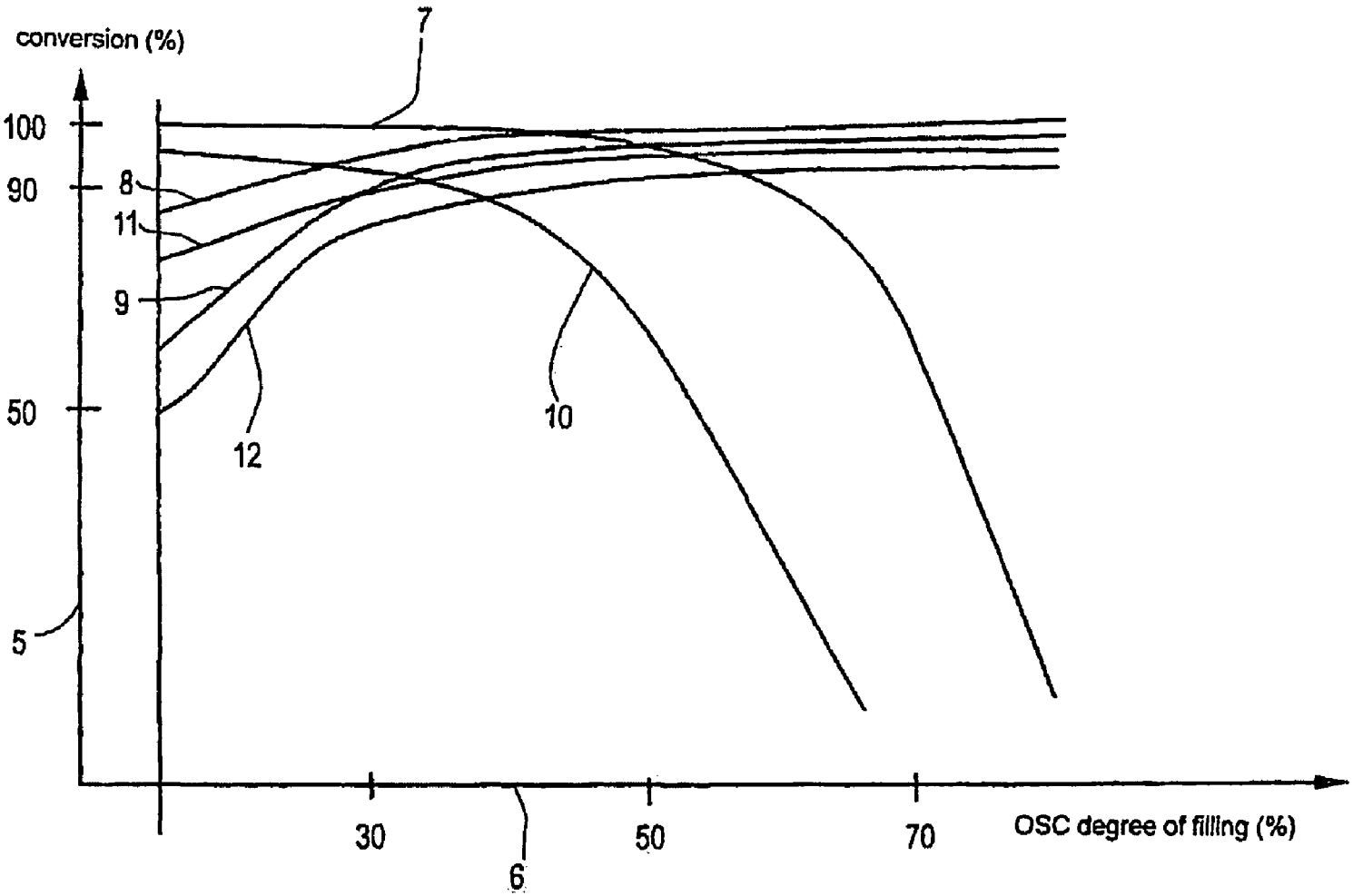
FIG. 2 shows an illustration of the conversion behavior underlying the method according to the invention for different types of emission.

FIG. 2 shows an illustration of the conversion behavior which underlies the method according to the invention for different types of emissions. Here the conversion in % is plotted on the y axis, the degree of oxygen filling in percent on the x axis.

Curve 7 indicates the conversion behavior of nitrogen oxides as a function of the degree of OSC filling for small masses of exhaust gas. Accordingly, curves 8 and 9 show the conversion behavior of hydrocarbons (curve 8) and carbon monoxide (curve 9) for small masses of exhaust gas.

The conversion curves deviate therefrom for large masses of exhaust gas. A conversion curve for nitrogen oxides for large masses of exhaust gas is reproduced here by curve 10 which, in comparison to curve 7 for small masses of exhaust gas, shows a much earlier drop of the degree of conversion with rising filling of the oxygen storage.

The corresponding conversion behavior for large masses of exhaust gas for hydrocarbons is shown by curve 11, the conversion behavior for carbon monoxide for large masses of exhaust gas is shown by curve 12. The curve characteristics show that especially for large masses of exhaust gas and a low degree of theoretical filling of the catalytic converter, consideration of the corresponding conversion values of the oxygen storage curves and oxygen discharge curves based on considerable deviations is expedient.

While for theoretical charging of, for example, somewhat less than 50% for small masses of exhaust gas at lambda=1, there is a steady-state point, for larger masses of exhaust gas and a theoretical charging value of appreciably below 50%, the location of the steady-state point at which the theoretical filling value is then kept deviates from lambda=1 in light of the fact that the conversion of carbon monoxide in this case takes place more poorly than that of nitrogen oxides and thus the raw emissions of carbon monoxide are above the raw emissions of nitrogen oxides. The value for the combustion air ratio, in order for the degree of oxygen filling being kept steady, is therefore not equal to 1.

Figure 3:
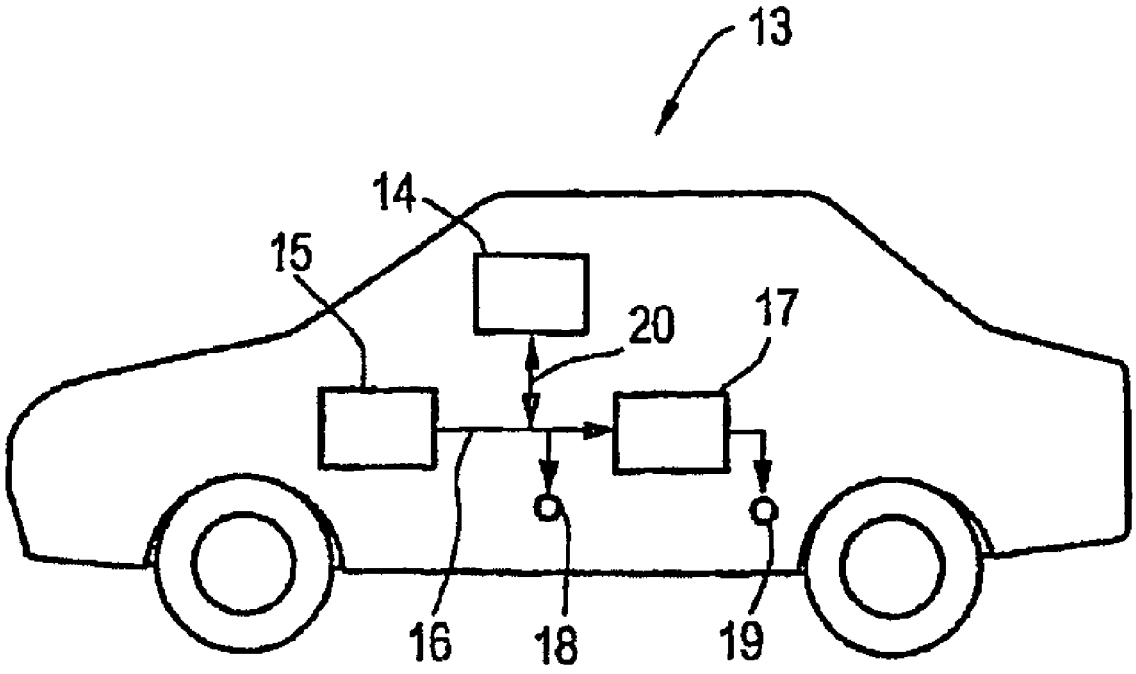
FIG. 3 shows a motor vehicle with a device according to the invention.

FIG. 3 finally shows a motor vehicle 13 according to the invention which has a device 14 according to the invention which in this embodiment is made as an onboard device for setting a predetermined value of oxygen filling of the oxygen storage reservoir of a catalytic converter 17 which is connected downstream from the engine 15 of the motor vehicle 13 according to arrow 16.

The voltage signals which constitute a measure of the filling of the oxygen reservoir of the catalytic converter 17 are recorded there by way of two oxygen probes 18 and 19 which are assigned to the catalytic converter 17. Here the two probes 18 and 19 are shown by way of example. It should be taken into account that in other embodiments there may be only one oxygen probe and there may be oxygen probes which are arranged differently with respect to a catalytic converter or which are used as a third or fourth probe and the like.

The device 14 according to the invention acquires, as is indicated here by the double arrow 20, from the system consisting of the engine 15, catalytic converter 17, and oxygen probes 18 and 19, optionally after retrieval, the required data which relate to the raw emission values for the components of the exhaust gas which are to be oxidized and reduced, and, in particular, conversion data or conversion curves encoded according to pollutants. The conversion curves or data can be determined optionally using the voltage signals of the probes 18, 19 from the data present in the device 14 (in a memory).

Using these data, the device 14 ultimately determines the combustion air ratio lambda for which an oxygen filling value, which is predetermined as the theoretical oxygen filling value, can be kept steady for the catalytic converter 17.

This exact consideration of the oxygen storage behavior and of the oxygen discharge behavior of the catalytic converter 17 according to the invention based on the raw emissions of the individual types of pollutants makes it possible to stably set the desired oxygen filling value without the occurrence of pollutant breakthroughs.

The invention claimed is:

1. A method comprising setting a predetermined oxygen filling value of an oxygen storage reservoir of a catalytic converter for a motor vehicle;

collecting raw emissions data during operation of the motor vehicle, wherein the exhaust gas data comprises information about pollutants in an exhaust gas stream of the motor vehicle, wherein the pollutants are components which are to be oxidized or reduced by the catalytic converter;

differentiating the raw emissions data by pollutant to obtain pollutant-differentiated raw emissions data;

determining a combustion air ratio based on the pollutant-differentiated raw emissions data converted to a change of the oxygen filling value of an oxygen storage reservoir of the catalytic converter as a function of a mass flow of exhaust gas, detecting an oxygen storage behavior and an oxygen discharge behavior of the catalytic converter;

wherein oxygen entry into and oxygen discharge out of the oxygen storage reservoir of the catalytic converter are corrected based on the oxygen storage behavior of the catalytic converter, the oxygen discharge behavior of the catalytic converter, and the converted raw emissions data for each of a plurality of individual pollutants;

resetting the predetermined oxygen filling value based on the combustion air ratio.

2. The method according to claim 1 wherein raw emission values are determined for at least one of hydrocarbons and carbon monoxide as the exhaust gas components which are to be oxidized and nitrogen oxides and oxygen as the exhaust gas components which are to be reduced.

3. The method according to claim 1, wherein balancing of at least one of oxygen entry into the catalytic converter and oxygen discharge from the catalytic converter is weighted by way of the relative oxygen filling of the catalytic converter such that at least one of the reaction rate of oxygen entry rises with a decrease of the relative oxygen filling, the reaction rate of oxygen discharge drops as the relative oxygen filling decreases, the reaction rate of oxygen entry declines with an increase of relative oxygen filling, and the reaction rate of oxygen discharge increases with the increase of the relative oxygen filling.

4. The method according to claim 1, wherein the combustion air ratio is determined as a function of values of an oxygen storage curve and an oxygen discharge curve of an oxygen storage reservoir of the catalytic converter, which values are assigned to a predetermined oxygen filling value.

5. The method according to claim 1, wherein an oxygen filling value is set for a catalytic converter which is in an equilibrium state.

6. The method according to claim 1, wherein the method is carried out when there are large masses of exhaust gas.

7. A device comprising means for setting a predetermined oxygen filling value of an oxygen storage reservoir of a catalytic converter for a motor vehicle;

means for collecting raw emissions data during operation of the motor vehicle, wherein the exhaust gas data comprises information about pollutants in an exhaust gas stream of the motor vehicle, wherein the pollutants are components which are to be oxidized or reduced by the catalytic converter;

means for differentiating the raw emissions data by pollutant to obtain pollutant-differentiated raw emissions data;

means for determining a combustion air ratio based on the pollutant-differentiated raw emissions data converted to a change of the oxygen filling value of an oxygen storage reservoir of the catalytic converter as a function of a mass flow of exhaust gas, means for detecting an oxygen storage behavior and an oxygen discharge behavior of the catalytic converter;

wherein oxygen entry into and oxygen discharge out of the oxygen storage reservoir of the catalytic converter are corrected based on the oxygen storage behavior of the catalytic converter, the oxygen discharge behavior of the catalytic converter, and the converted raw emissions data for each of a plurality of individual pollutants;

means for resetting the predetermined oxygen filling value based on the combustion air ratio.

8. A motor vehicle including a device as set forth in claim 7.

* * * * *